US008104238B2

(12) United States Patent
Wilson

(10) Patent No.: US 8,104,238 B2
(45) Date of Patent: Jan. 31, 2012

(54) WINDOW SPACER AND CORNER-FASTENING CONCEPT

(75) Inventor: Richard Wilson, Hudson, OH (US)

(73) Assignee: Formtek Metal Forming, Inc., Westfield, MA (US)

( * ) Notice: Subject to any disclaimer, the term of this patent is extended or adjusted under 35 U.S.C. 154(b) by 294 days.

(21) Appl. No.: 11/939,231

(22) Filed: Nov. 13, 2007

(65) Prior Publication Data

US 2008/0134627 A1 Jun. 12, 2008

Related U.S. Application Data

(60) Provisional application No. 60/866,245, filed on Nov. 17, 2006.

(51) Int. Cl.

| | |
|---|---|
| ***E06B 3/00*** | (2006.01) |
| ***E04C 2/30*** | (2006.01) |
| *E06B 3/96* | (2006.01) |
| *E04C 2/38* | (2006.01) |

(52) U.S. Cl. ..... 52/172; 52/658; 52/656.7; 52/786.13; 403/280; 403/329; 403/DIG. 14

(58) Field of Classification Search ..... 52/172, 52/656.6, 656.7, 656.9, 658, 786.13; 403/264, 403/280, 329, 397, DIG. 14, 274, 275, 276, 403/277, 278, 279, 281, 282, 283, 284, 285, 403/DIG. 4; 428/34

See application file for complete search history.

(56) References Cited

U.S. PATENT DOCUMENTS

| | | | | | |
|---|---|---|---|---|---|
| 1,236,678 | A * | 8/1917 | Crawford | 15/145 |
| 1,557,066 | A * | 10/1925 | Krantz | 220/690 |
| 1,970,422 | A * | 8/1934 | Foster | 403/300 |
| 2,488,849 | A * | 11/1949 | Churchill | 16/42 R |
| 2,634,867 | A * | 4/1953 | Shields | 211/153 |
| 2,952,342 | A * | 9/1960 | Schnittker | 52/658 |
| 2,990,921 | A * | 7/1961 | Wilde | 403/178 |
| 3,164,284 | A * | 1/1965 | Bergh et al. | 220/4.28 |
| 3,327,764 | A * | 6/1967 | McCabe | 160/5 |
| 3,327,766 | A * | 6/1967 | Kurz | 160/381 |
| 3,429,076 | A * | 2/1969 | Fortsch et al. | 49/504 |
| 3,967,351 | A * | 7/1976 | Rosenberg et al. | 24/616 |
| 4,222,209 | A * | 9/1980 | Peterson | 52/172 |
| 4,431,691 | A * | 2/1984 | Greenlee | 428/34 |
| 4,479,737 | A * | 10/1984 | Bergh et al. | 403/382 |
| 4,513,549 | A * | 4/1985 | Wendt | 52/211 |
| 4,850,175 | A * | 7/1989 | Berdan | 52/786.13 |
| 4,912,837 | A * | 4/1990 | Bayer | 29/451 |
| 5,333,965 | A * | 8/1994 | Mailey | 403/326 |
| 5,617,699 | A * | 4/1997 | Thompson, Jr. | 52/786.13 |
| 5,678,377 | A * | 10/1997 | Leopold | 52/656.9 |
| 5,833,377 | A * | 11/1998 | Keller et al. | 400/208 |
| 5,881,525 | A * | 3/1999 | Riegelman et al. | 52/656.7 |
| 6,038,825 | A * | 3/2000 | Shah et al. | 52/172 |
| 6,360,420 | B2 * | 3/2002 | Shah et al. | 29/458 |
| 6,643,988 | B1 * | 11/2003 | Armstrong et al. | 52/656.2 |
| 7,114,277 | B2 * | 10/2006 | Valiulis et al. | 40/648 |
| 2002/0197106 | A1 * | 12/2002 | Wu | 403/329 |

* cited by examiner

*Primary Examiner* — Brian Glessner
*Assistant Examiner* — Joseph J Sadlon
(74) *Attorney, Agent, or Firm* — McCormick, Paulding & Huber LLP

(57) ABSTRACT

A window spacer for integrated glass units is disclosed. The window spacer has an elongated housing with two distal ends. The housing is bent upon itself so that the distal ends are adjacent to each other. One end has an engaging slot, and the other end has an engaging member formed in it. When the engaging member is inserted into the engaging slot, a restraining portion of the engaging member prevents the engaging member from disengaging from the engaging slot.

6 Claims, 3 Drawing Sheets

WINDOW SPACER AND CORNER-FASTENING CONCEPT

CROSS REFERENCE TO RELATED APPLICATIONS

This application claims the benefit of U.S. Provisional Application Ser. No. 60/866,245, filed on Nov. 17, 2006, herein incorporated by reference in its entirety.

FIELD OF THE INVENTION

This invention relates in general to a window spacer and corner-fastening assembly. More particularly, the invention deals with a window spacer that has a spacing running completely around the inside center to allow a desiccant to absorb moisture. In addition, the invention deals with a corner-fastening assembly that has a self-alignment system that does not require any additional hardware to hold the corners together.

BACKGROUND OF THE INVENTION

The present invention is used in the manufacturing of Integrated Glass Units (IGUs) for use in residential and commercial windows. An IGU is typically assembled using two pieces of glass, which are separated by a metal spacer. The glass is permanently attached to the spacer using an adhesive, making the IGU a sealed airtight assembly.

Typically, window spacers also include an area for a desiccant to absorb any moisture in the sealed IGU. Changing temperatures throughout the year causes the glass in windows to bow inwardly and outwardly. These movements also allow moisture between the two pieces of glass. Other window spacers either have the desiccant exposed or have holes around the inside of the spacer allowing the desiccant to work. However, the exposed desiccant is aesthetically unattractive. If the desiccant is exposed, it must be applied uniformly around the window edge in order to maintain a symmetrical appearance.

Window spacers have also employed a variety of ways to hold the corners of the spacer together. Early spacers were assembled from four individual linear spacer members. Then, these members were connected by corner segments known as corner keys. The problem with this design is that the spacer has to be fully formed before applying the sealant to each of the segments, which requires the spacer to be awkwardly rotated while applying the sealant. A variation of this design allowed the corner key to be folded. With this design, the segments of the window spacer are linear, so the sealant can be easily applied. Then, the segments can be folded into its rectangular form. However, this design also has problems; it still requires additional hardware to hold the corner together such as the corner key described or a mechanical screw. Integral spacers have been attempted to alleviate this problem by creating a single member that has appropriately spaced corner structures and can be bent into its final rectangular form. However, this design causes misalignment or buckling when assembling it in its rectangular form.

With the forgoing problems and concerns in mind, it is the general object of the present invention to provide a window spacer and corner-fastening assembly, which overcome the above-described drawbacks while maximizing efficiency and simplicity in the assembling process.

SUMMARY OF THE INVENTION

It is an object of the present invention to provide a window spacer.

It is another object of the present invention to provide a window spacer that may significantly reduce the assembly time of IGUs.

It is another object of the present invention to provide a window spacer that has a spacing running completely around the inside center when folded into a square or rectangle.

It is another object of the present invention to provide a window spacer that may be fitted together manually without additional hardware.

It is another object of the present invention to provide a window spacer that may be easily fitted together by hand.

It is another object of the present invention to provide a window spacer with a corner that has a self-alignment feature.

It is another object of the present invention to provide a window spacer with a corner that has a self-alignment feature punched into the flat metal.

It is another object of the present invention to provide a window spacer that does not have the desiccant exposed or have holes around the inside of the spacer to allow the desiccant to work.

These and other objectives of the present invention, and their preferred embodiments, shall become clear by consideration of the specification, claims and drawings taken as a whole.

DETAILED DESCRIPTION OF THE PREFERRED EMBODIMENT

The present invention is used for the manufacturing of known Integrated Glass Units (IGUs) for use in residential and commercial windows. The IGU is assembled using two panes of glass, which are separated by a metal spacer. The glass is permanently attached to the spacer using an adhesive, which makes the IGU a sealed airtight assembly. The present invention seeks to address the shortcomings of prior window spacers.

The metal spacer of the present invention is roll formed from varying widths of flat metal stock, which create varying width finished spacers. The process of roll-forming metal stock into a desired configuration is well known, and therefore, the machinery and methodology of doing so will not be further expanded upon in the present specification.

An upstream punch device is designed to notch the flat stock to create a corner-fastening assembly. A desiccant may also be placed along a central length of the metal stock prior to the formation of the spacer. Then, the spacer exits the roll-forming machine in its desired configuration. The spacer is then bent into a substantially quadrangular shape, such as a rectangle or square. Each end of a fourth corner of the spacer is locked together using the corner-fastening assembly without the need for a screw or other like fastening devices.

The precise manner in which the ends are fastened will be described in more detail later; however, it will become readily appreciated that the corner-fastening assembly, absent the use of any additional fastening devices, represents an arrangement heretofore unknown in the art.

Figure 1:
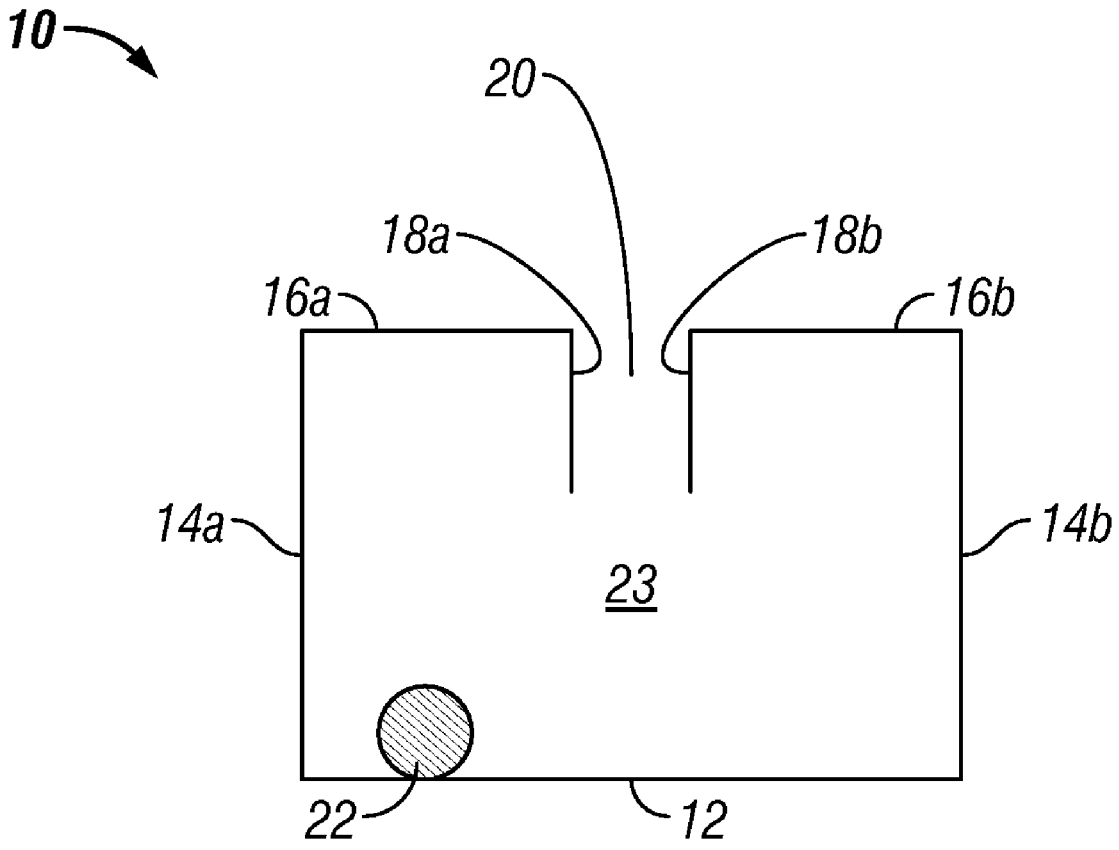
FIG. 1 is a cross-sectional view of a window spacer, according to one embodiment of the present invention.

FIG. 1 illustrates a cross-sectional view of a window spacer 10, according to one embodiment of the present invention. As shown in FIG. 1, the window spacer 10 includes a base 12, two sidewalls 14*a* and 14*b*, and two top surfaces 16*a* and 16*b*. As shown further in FIG. 1, the flanges 18*a* and 18*b* extend downwardly from the top surfaces 16*a* and 16*b*, respectively, extending towards an inner cavity 23 of the spacer 10. The area between the flanges 18*a* and 18*b* creates a spacing 20, through which a desiccant 22 may be deposited within the cavity 23 of window spacer 10, as discussed above.

It is therefore an important aspect of the present invention that the window spacer 10 has a spacing 20, which runs completely along the length of the window spacer 10. This spacing 20 permits the desiccant 22 to be exposed to the interior of the IGU so that any moisture may be absorbed by the desiccant 22. In production, the window spacer 10 exits a roll-forming machine in a linear state with a desiccant 22 placed where the cavity 23 of the window spacer 10 will be formed. Thus, the desiccant 22 may be easily placed in the cavity 23 of the window spacer 10 before it is substantially sealed off in its final form.

Figure 2:
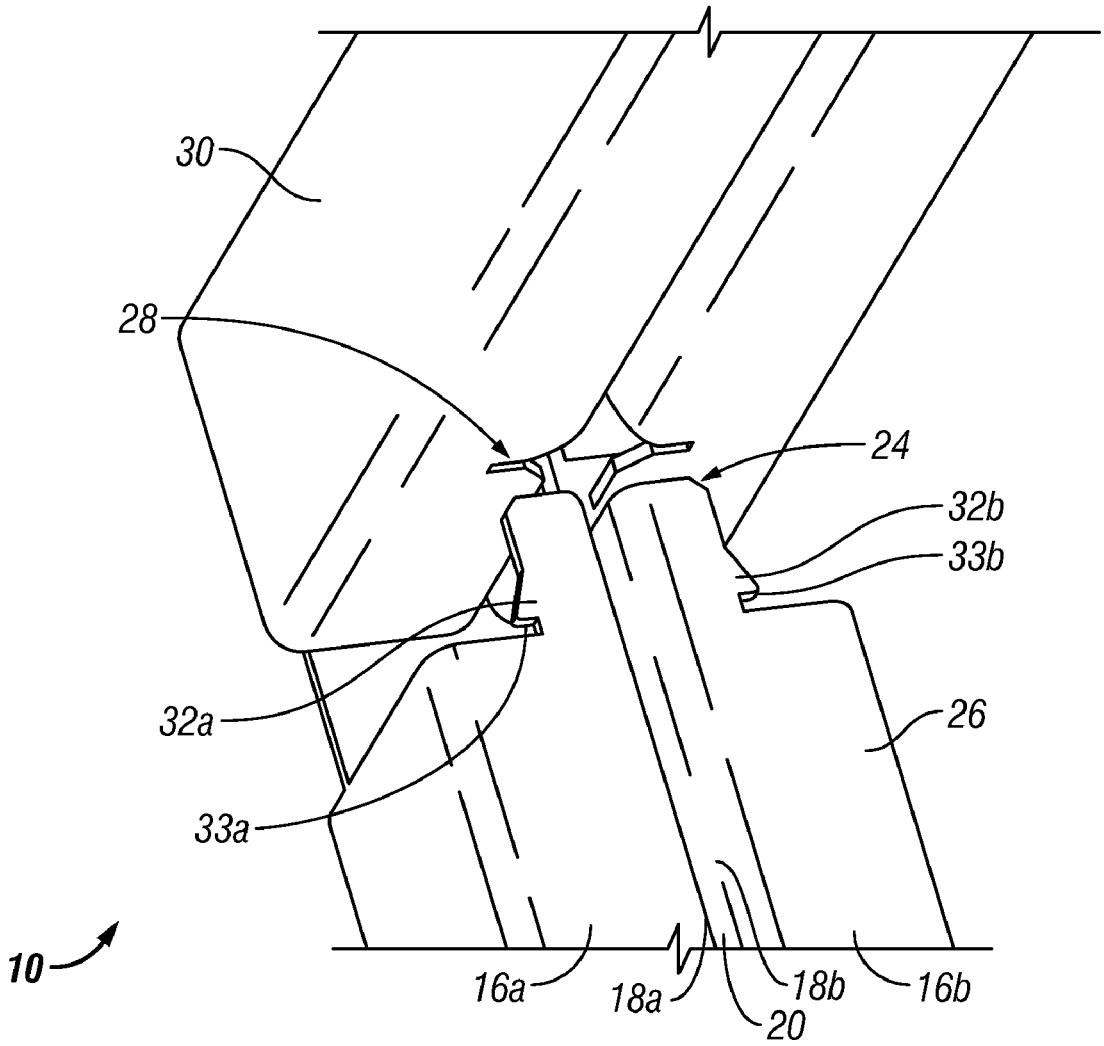
FIG. 2 is a fragmentary view of the inner corner of a window spacer of an embodiment of the present invention.

FIG. 2 illustrates the inner corner of the window spacer 10 after being bent to form a quadrangular shape. The window spacer 10 is designed to allow for the bending of the first three corners to form a square or rectangle. The fourth corner, shown in FIG. 2, employs a corner-fastening assembly that locks both ends together without the need for a screw or other fastening device.

As shown in FIG. 2, an engaging member 24 on end 26 of the present invention is inserted into an engaging slot 28 on end 30. The engaging member 24 is an extension of a portion of the top surfaces 16*a* and 16*b* as well as flanges 18*a* and 18*b* and spacing 20. A pair of angled restraining portions 32*a* and 32*b* is formed on each side of the engaging member 24. A pair of tips 33*a* and 33*b* is disposed on the ends of each of the restraining portions 32*a* and 32*b*. The engaging slot 28 is designed to allow the full width of the engaging member 24 to be inserted. That is, the angled shape of the restraining portions 32*a* and 32*b* allows the engaging member 24 to contract as it is pushed through the engaging slot 28 due to the spacing 20. Because of the resiliency of the window spacer material, the engaging member 24 returns to its original shape and width and is locked in place within the inner cavity 23. Thus, once the engaging member 24 is inserted into the engaging slot 28, the restraining portions 32*a* and 32*b* prevents the engaging member 24 from disengaging from the engaging slot 28 since the tips 33*a* and 33*b* are unable to clear the engaging slot 28.

The engaging member 24 and the engaging slot 28 of the top surface 16 of the window spacer 10 is only half of the corner-fastening assembly. Another means to align ends 26 and 30 at the fourth corner of the window spacer 10 is located at the corner of the base 12.

Figure 3:
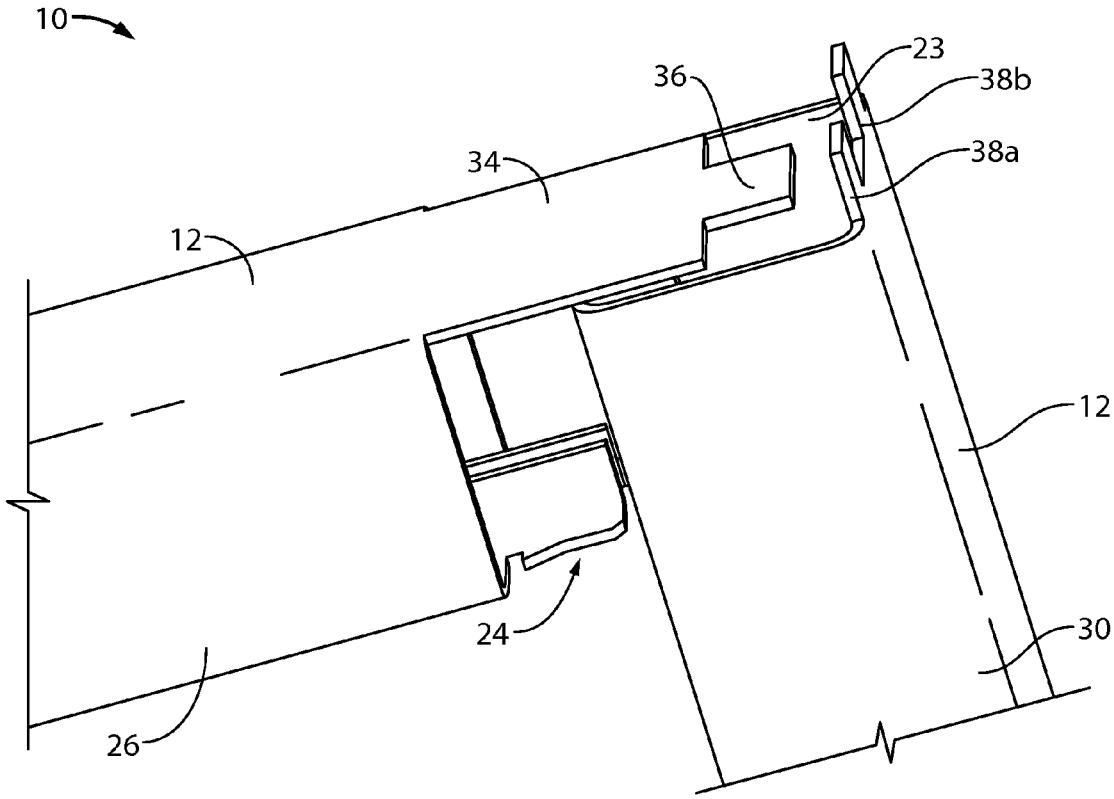
FIG. 3 is a fragmentary view of the outer corner of the window spacer of FIG. 2.

Turning now to FIG. 3, the base 12 of end 26 has an extension 34. The extension 34 ends with a tab 36. The length and width of extension 34 matches the length and width of end 30 so that when the fourth corner is fastened, the base 12 of window spacer 10 completely seals off the cavity 23.

The end 30 also has two tabs 38*a* and 38*b*. As shown, each tab is located on the left and right edge of end 30. The space between tabs 38*a* and 38*b* allows for tab 36 between them. Tabs 36, 38*a*, and 38*b* align the surfaces of ends 26 and 30 when ends 26 and 30 are placed together.

FIG. 3 also illustrates the full corner-fastening assembly. Besides the aligning of the base 12 described above, the engaging member 24 on end 26 is also shown.

As described above, the window spacer 10 is initially roll formed into an elongated housing with end 26 on one side and end 30 on the other side. Then, the housing is bent upon itself to form the contours of the window. This bending process causes end 26 to be brought into alignment and contact with end 30. At this time, engaging member 24 is inserted into engaging slot 28, and tab 36 is placed between tabs 38*a* and 38*b*. When tabs 36, 38*a*, and 38*b* are in a substantial touching relationship, the corner is properly aligned. Upon fastening, the top surface 16 of end 30 closes the exposed cavity 23 of end 26, and the extension 34 of end 26 closes the exposed cavity 23 of end 30. Then, the only opening in window spacer 10 is spacing 20.

It is therefore an important aspect of the present invention that the corner-fastening assembly has a self-alignment feature. The window spacer 10 is aligned at both the top surface 16 and the base 12 of the fourth corner. The base 12 is aligned by the specific placement of tab 36 between tabs 38*a* and 38*b*. Tab 36 perfectly fits between tabs 38*a* and 38*b* so that the base 12 cannot be moved or misaligned. The top surface 16 is aligned by insertion of the engaging member 24 into the engaging slot 28. As shown in FIG. 2, restraining portions 32*a* and 32*b* do not extend all the way to the edge of the top surface 16. Thus, in this embodiment, some movement is allowed along the top surface 16, but this movement is limited by the width of the engaging slot 28 and the engaging member 24.

It is another important aspect of the present invention that the corner-fastening assembly does not require any additional hardware to hold the corner together like a mechanical screw or a corner key. Tab 36 is simply placed between tabs 38*a* and 38*b* in order to align the window spacer 10, and the insertion of engaging member 24 into the engaging slot 28 provides securing means.

While the present invention has been described in connection with the specific structures shown in FIGS. 1-3, the window spacer 10 is not so limited in this regard. That is, the sidewalls 14 may be configured to any shape rather than being completely linear. Furthermore, FIG. 3 employs three tabs 36, 38*a*, and 38*b* to align the fourth corner of the window spacer 10. However, any number of tabs may be used to accomplish the function of the present invention. Moreover, restraining portions 32*a* and 32*b* may be any shape that allows the engaging member 24 to be inserted into the engaging slot 28 but prevents the engaging member 24 from disengaging with the engaging slot 28.

As will be appreciated by consideration of the embodiments illustrated in FIGS. 1-3, the present invention provides a window spacer that has a spacing running completely around the inside center to allow a desiccant to absorb moisture without the desiccant being visibly exposed. Moreover, the window spacer of the present invention deals with a corner-fastening assembly that has a self-alignment system that does not require any additional hardware to hold the corners together.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all equivalent embodiments.

What is claimed is:

1. A window spacer, comprising:

an elongated housing defined by a base, two sidewalls, two top surfaces and two flanges extending downwardly from said top surfaces and forming a spacing therebetween, said housing further having a first distal end and a second distal end and being bent upon itself so that said first distal end is adjacent said second distal end;

an engaging slot in said first distal end;

an engaging member formed in said second distal end, said engaging member including a pair of angled restraining portions separated from one another by a gap and being planar with said two top surfaces of said second distal end, said angled restraining portions and said gap being extensions of said top surfaces and said spacing;

wherein when said engaging member is inserted into said engaging slot, a restraining portion of said engaging member prevents said engaging member from disengaging from said engaging slot;

an extension ending with a tab on one of said first and second distal ends, said extension dimensioned so as to substantially seal off the other of said first and second distal ends; and at least two other tabs on said other of said first and second distal ends, said at least two other tabs being separated by a gap dimensioned to receive said tab of said extension, wherein when said at least two other tabs and said tab of said extension are in a touching relationship, said distal ends are aligned such that substantially the only opening in said window spacer is said spacing.

2. The window spacer according to claim 1, further comprising:

a desiccant positioned within an interior cavity of said elongated housing.

3. The window spacer according to claim 1, wherein said engaging member temporarily contracts when inserted into said engaging slot.

4. The window spacer according to claim 1, wherein said housing has an inner cavity and said engaging member is locked in place within said inner cavity.

5. A window spacer, comprising:

an elongated housing defined by a base, two sidewalls, two top surfaces and two flanges extending downwardly from said top surfaces and forming a spacing therebetween, said housing further having a first distal end and a second distal end and being bent upon itself so that said first distal end is adjacent said second distal end;

an engaging slot in said first distal end; and an engaging member formed in said second distal end and having a pair of angled restraining portions separated by a gap and being substantially planar with said two top surfaces of said second distal end, said angled restraining portions and said gap being extensions of said top surfaces and said spacing;

wherein said angled restraining portions and said gap define a first width of said engaging member;

wherein said angled restraining portions are contractable about said gap upon insertion into said engaging slot such that said engaging member is variable from said first width to a second width, said second width being less than said first width; and wherein when said engaging member is fully inserted into said engaging slot, said angled restraining portions of said engaging member expand about said gap such that said engaging member is varied from said second width to said first width to prevent said engaging member from disengaging from said engaging slot.

6. A window spacer, comprising:

an elongated housing defined by a base, two sidewalls, two top surfaces and two flanges extending downwardly from said top surfaces and forming a spacing therebetween, said housing further having a first distal end and a second distal end and being bent upon itself so that said first distal end is adjacent said second distal end;

an engaging slot in said first distal end;

an engaging member formed in said second distal end, said engaging member including a pair of opposed, angled restraining portions separated by a gap and being substantially planar with said two top surfaces of said second distal end, said angled restraining portions and said gap being extensions of said top surfaces and said spacing;

an extension ending with a tab on one of said first and second distal ends, said extension dimensioned so as to substantially seal off the other of said first and second distal ends;

at least two other tabs on said other of said first and second distal ends, said at least two other tabs being separated by a gap dimensioned to receive said tab of said extension, wherein when said at least two other tabs and said tab of said extension are in a touching relationship, said distal ends are aligned such that substantially the only opening in said window spacer is said spacing;

wherein said angled restraining portions are movable towards one another about said gap to decrease a dimension of said gap therebetween upon insertion of said engaging member into said engaging slot; and wherein when said engaging member is fully inserted into said engaging slot, said angled restraining portions of said engaging member move away from one another to increase said dimension of said gap therebetween and prevent said engaging member from disengaging from said engaging slot.

* * * * *